US011602785B2

(12) United States Patent
Jo et al.

(10) Patent No.: US 11,602,785 B2
(45) Date of Patent: Mar. 14, 2023

(54) METHOD OF FORMING CASTING WITH FLOW PASSAGE, AND CASTING FORMED BY THE SAME

(71) Applicants: HYUNDAI MOTOR COMPANY, Seoul (KR); KIA MOTORS CORPORATION, Seoul (KR)

(72) Inventors: Young-Rae Jo, Hwaseong-si (KR); Hyo-Moon Joo, Seoul (KR); Min-Soo Kim, Seoul (KR); Ji-Yong Lee, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 194 days.

(21) Appl. No.: 16/691,319

(22) Filed: Nov. 21, 2019

(65) Prior Publication Data

US 2020/0246862 A1 Aug. 6, 2020

(30) Foreign Application Priority Data

Jan. 31, 2019 (KR) ..... 10-2019-0013003

(51) Int. Cl.

| | |
|---|---|
| ***B22D 19/00*** | (2006.01) |
| ***B22C 9/10*** | (2006.01) |
| ***B22D 17/00*** | (2006.01) |
| ***C22C 21/02*** | (2006.01) |

(52) U.S. Cl.

CPC ..... *B22D 19/0072* (2013.01); *B22C 9/10* (2013.01); *B22D 17/00* (2013.01); *C22C 21/02* (2013.01)

(58) Field of Classification Search

CPC ..... B22C 9/10; B22C 9/101; B22C 9/106; B22C 9/108; B22C 21/14; B22D 17/00; B22D 17/24; B22D 19/00; B22D 19/0072; B21C 1/22; B21C 23/085; C22C 21/02

USPC ..... 164/98, 112, 137, 369; 428/596

See application file for complete search history.

(56) References Cited

U.S. PATENT DOCUMENTS

2015/0083356 A1* 3/2015 Longa et al. ..... B22C 9/106 164/15

FOREIGN PATENT DOCUMENTS

DE 10026546 A1 11/2001
KR 10-2000-0017994 A 4/2000

OTHER PUBLICATIONS

Extended European Search Report dated May 14, 2020 issued in European Patent Application No. 19209087.6.

(Continued)

*Primary Examiner* — Kevin P Kerns

(74) *Attorney, Agent, or Firm* — Morgan, Lewis & Bockius LLP

(57) ABSTRACT

A method of forming a casting with a flow passage may include filling a tubular pipe with a filler to form a smart core; inserting the smart core into a mold having a cavity corresponding to a shape of the casting to be formed; injecting a molten metal into the cavity through a casting process; and removing the filler from the smart core, wherein a hardness of the tubular pipe is 70 Hv or more.

9 Claims, 12 Drawing Sheets

(56) References Cited

OTHER PUBLICATIONS

S. Rupp, "Stabile gefullte Einlegerohre fur GieBerein," Jan. 1, 2015, retrieved on Feb. 24, 2020 on the internet: URL:https://cdn.industriepreis.de/f/64e4606555217350/industriepreis/2015/20051/10745/27954/258d7a491108e48af85b904cef4654.pdf.

S. Rupp, et al., "Combicore-GieBkerne fur en den Druckguss. Stabile salzkerne fur komplexe kanale und endkonturnahen Leichtbau," Giesserei, vol. 103, No. 03/2016, Mar. 1, 2016, pp. 56-61.

Chinese Office Action dated Jun. 23, 2022, issued in corresponding Chinese Patent Application No. 201911158726.7 (with English translation).

* cited by examiner

METHOD OF FORMING CASTING WITH FLOW PASSAGE, AND CASTING FORMED BY THE SAME

CROSS-REFERENCE(S) TO RELATED APPLICATIONS

This application claims priority to Korean Patent Application No. 10-2019-0013003, filed on Jan. 31, 2019, the disclosure of which is incorporated herein by reference in its entirety.

BACKGROUND OF THE DISCLOSURE

Field of the Disclosure

Exemplary embodiments of the present disclosure relate to a method of forming a casting; and, particularly, to a method of forming a casting with a flow passage formed therein, and a casting formed by the method.

Description of Related Art

Recently, as development of electric vehicles, hybrid vehicles have become more active, a variety of power converting components such as a driving motor, an inverter, and a converter have substituted for conventional components for an internal combustion engine such as an engine and a transmission.

Such power converting components generate a lot of heat during a process of charging electricity and converting the electricity into power to be used, compared to that of the conventional components.

Hence, a flow passage for cooling is necessarily required for the power converting components in the same manner as that of other components which generate a lot of heat.

In a conventional art, to form a flow passage in a component produced through a casting process, as shown in FIG. 1, two parts with flow passages 1 are formed through casting processes and coupled with each other by bolts 3 or the like, and a gasket 2 is interposed between the two parts to ensure the airtightness of the junction therebetween. In this way, a casting 1 with a flow passage 4 is produced.

In the conventional method, a process of forming a casting is complex because two pieces of parts should be manufactured and then coupled with each other through a mechanical coupling scheme. In addition, if the interior of the casting is defective or the gasket is damaged, leakage may be caused, whereby there is a probability of permeation of water into a power semiconductor. If that occurs, a related system may cause malfunction, and a fire may occur in a vehicle. Therefore, development of a technique for enhancing robustness of the flow passage of the power converting component is required.

The foregoing is intended merely to aid in the understanding of the background of the present disclosure, and is not intended to mean that the present disclosure falls within the purview of the related art that is already known to those skilled in the art.

SUMMARY OF THE DISCLOSURE

An embodiment of the present disclosure is directed to a method of forming a casting with a flow passage and a casting formed by the method which may reduce the production cost and enhance the robustness of an internal flow passage.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the means as claimed and combinations thereof.

In accordance with an embodiment of the present disclosure, there is provided a method of forming a casting with a flow passage, including: filling a tubular pipe with a filler to form a smart core; inserting the smart core into a mold having a cavity corresponding to a shape of the casting to be formed; injecting molten metal into the cavity through a casting process; and removing the filler from the smart core, wherein a hardness of the tubular pipe is 70 Hv or more.

The casting process may be performed through a high-pressure casting process.

An elongation of the tubular pipe may be 15% or more.

A particle size of the filler may be 100 μm or less.

A thermal conductivity of the filler may range from 0.1 W/m·° C. to 1 W/m·° C.

The method of forming of the smart core may include: filling the tubular pipe with the filler; drawing and extruding the tubular pipe filled with the filler; and bending the tubular pipe in a shape corresponding to a shape of the flow passage to be formed in the casting.

The molten metal and the tubular pipe may be formed of an identical material.

The tubular pipe may be formed of aluminum.

According to an exemplary embodiment of the present disclosure, the molten metal may include Aluminum (Al) as a base or a majority of the composition, and Copper (Cu) of 5.0 wt % or less, Silicon (Si) of 18.0 wt % or less, Magnesium (Mg) of 8.6 wt % or less, Zinc (Zn) of 3.0 wt % or less, Iron (Fe) of 1.8 wt % or less, Manganese (Mn) of 0.6 wt % or less, Nickel (Ni) of 0.5 wt % or less, and Tin (Sn) of 0.3 wt % or less, with reference to the total weight.

A thickness of the tubular pipe may be 1.25 mm or more and less than 4 mm.

In accordance with an embodiment of the present disclosure, there is provided a method of forming a casting with a flow passage, including: filling a tubular pipe with a filler to form a smart core; inserting the smart core into a mold having a cavity corresponding to a shape of the casting to be formed; injecting molten metal into the cavity through a casting process; and removing the filler from the smart core, wherein a particle size of the filler may be 100 μm or less.

The filler may be formed of silica-based material.

A thermal conductivity of the filler may range from 0.1 W/m·° C. to 1 W/m·° C.

In accordance with an embodiment of the present disclosure, there is provided a casting formed integrally with a tubular pipe having a flow passage shape through a casting process, wherein a hardness of the tubular pipe is 70 Hv or more.

Molten metal and the tubular pipe may be formed of an identical material.

The tubular pipe may be formed of aluminum.

A thickness of the tubular pipe may be 1.25 mm or more and less than 4 mm.

The tubular pipe may have a bent flow passage shape, and an elongation of the tubular pipe may be 15% or more.

DESCRIPTION OF SPECIFIC EMBODIMENTS

Exemplary embodiments of the present disclosure will be described below in more detail with reference to the accompanying drawings so as to make those skilled in the art fully understand operational advantages and objects of the present disclosure.

If in the specification, detailed descriptions of well-known functions or configurations would unnecessarily obfuscate the gist of the present disclosure, the detailed descriptions will be shortened or omitted.

Figure 1:
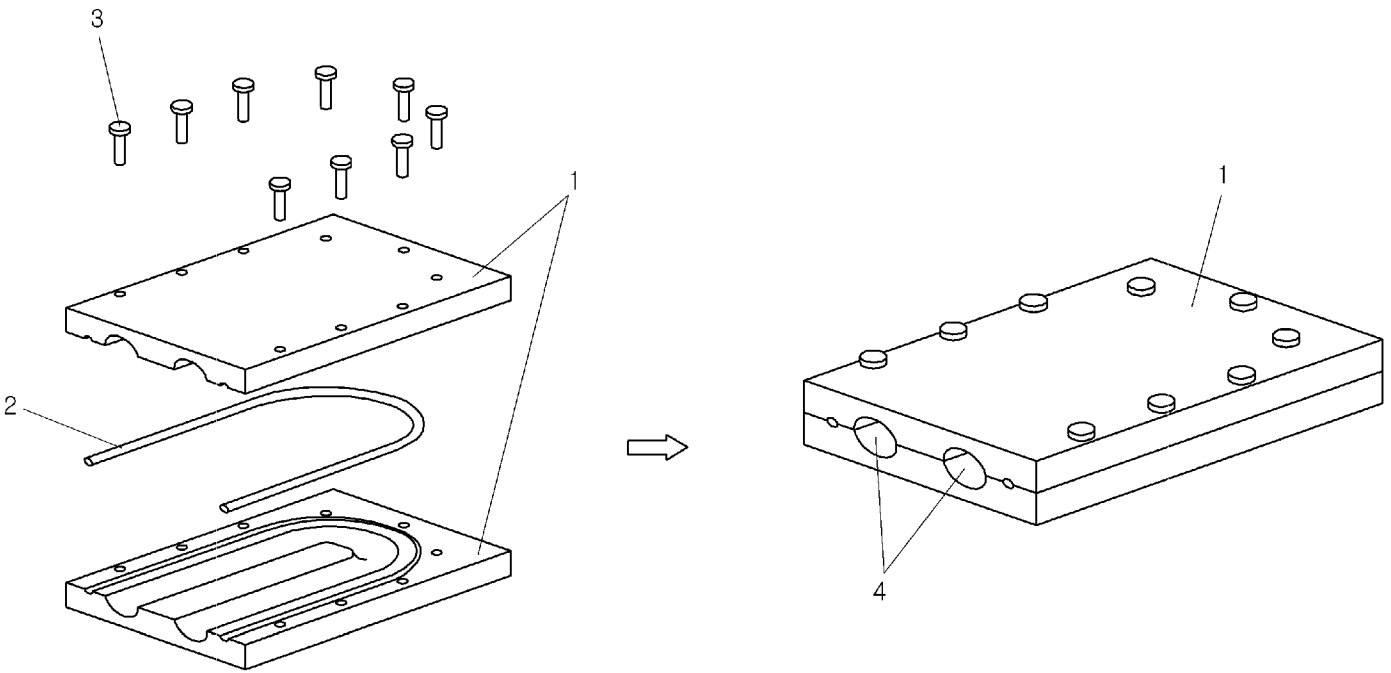
FIG.1 (PRIOR ART)
FIG. 1 illustrates a conventional method of forming a casting with a flow passage.
Figure 2:
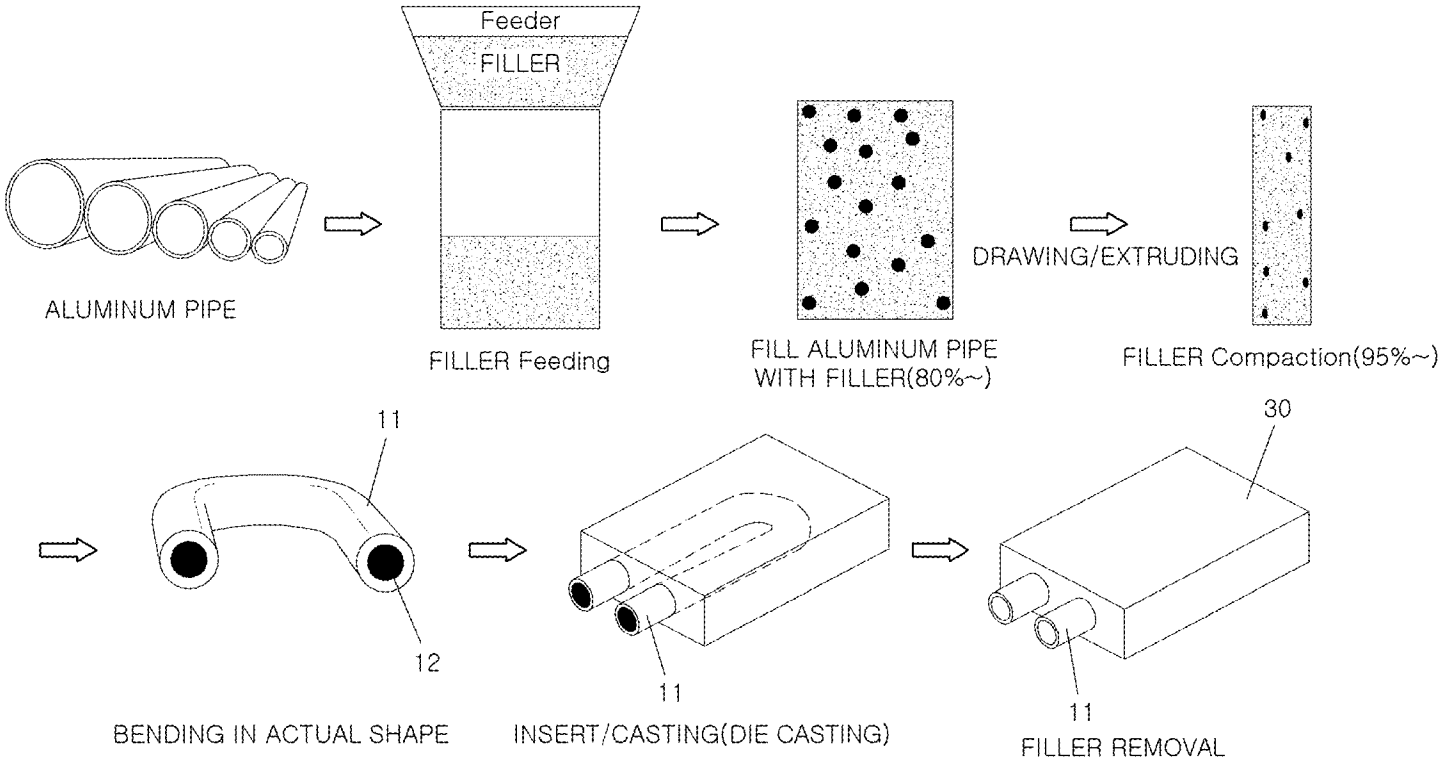
FIG. 2 illustrates a method of forming a casting with a flow passage in accordance with the present disclosure.

FIG. 2 illustrates a method of forming a casting with a flow passage in accordance with the present disclosure. Hereinafter, a method of forming a casting with a flow passage, and a casting formed by the method in accordance with an embodiment of the present disclosure will be described with reference to FIG. 2.

The present disclosure provides a method of forming a casting in which, unlike the conventional art, a casting with a flow passage is integrally formed into one piece through a casting process using a so-called smart core, whereby the robustness of the flow passage can be secured and there are economic advantages.

To achieve the above purposes, in the method according to the present disclosure, a tubular pipe to be formed into a flow passage is prepared.

Although an aluminum pipe is illustrated in the drawing, the tubular pipe according to the present disclosure is not limited to an aluminum pipe, and this will be described in detail below.

In the case where aluminum material is used to form a casting, it is preferable that an aluminum pipe be used.

Thereafter, the tubular pipe is filled with a filler by at least 80% of the volume of the tubular pipe using a feeder.

It is possible for the tubular pipe for forming the flow passage to endure pressure generated during the high-pressure casting process when the tubular pipe is filled with the filler while a casting with a flow passage is integrally formed into one piece through a casting process, and the filler is removed in a final operation.

Subsequently, the tubular pipe filled with the filler is reduced in cross-sectional area and increased in length by drawing and extruding so that the internal filler can be compacted to at least about 95%.

Furthermore, opposite ends of the tubular pipe are filled with resin or the like so as to prevent the internal filler from leaking out.

In the case where the opposite ends of the tubular pipe are filled with resin, during a subsequent filler removing process, the portions of the tubular pipe that are filled with the resin are cut out, and thereafter the filler is removed.

Subsequently, the smart core in which the tubular pipe 11 is filled with the filler 12 is completed by bending the tubular pipe 11 in a shape corresponding to an actual shape of the flow passage.

Although it is more preferable that the present disclosure is applied to a casting with a flow passage having a bent part, it is clear that the present disclosure may also be applied to a process of forming castings having other types of flow passages.

In the present disclosure, the smart core manufactured through the above-mentioned process is inserted into a mold formed in the form of a target product and processed by a die casting, thus embodying a desired casting 30.

In the smart core according to the present disclosure, since the tubular pipe configured to form the flow passage is compactly filled with the filler, it is possible to perform a casting process without deformation of the smart core even by molten metal injected at high pressure generated by high-pressure casting.

Furthermore, the material of the tubular pipe may be selected depending on the material of a target casting to be formed.

Particularly, in the case where aluminum is used as a molten metal, the tubular pipe is also manufactured using aluminum. Thus, the tubular pipe may be integrally joined with the casting when the casting process is performed after the insert process. In this case, the thermal conductivity is increased by aluminum, whereby the cooling performance can be enhanced. A joining interface may be formed within 30 μm, and more preferably, the tubular pipe may be joined with the casting without an interface.

In other words, although the tubular pipe and the molten metal are the same material, and particularly, are formed of aluminum, this means that base materials of alloys used to form the tubular pipe and the molten metal are the same, and detail components of the alloys may differ from each other.

When a casting is formed through a high-pressure casting process to produce an aluminum part, a tubular pipe formed of steel is used for the smart core. In such a case, an interface having a thickness ranging from 300 μm to 500 μm is formed between an aluminum surface and a steel surface, and the thermal conductivity may be reduced although an undesirable compression phenomenon does not occur.

The present disclosure may be applied to the case where different materials are used for the tubular pipe and the molten metal depending on purposes of a target casting to be formed, so that a casting with a robust flow passage may be formed by the high-pressure casting process.

Figure 3:
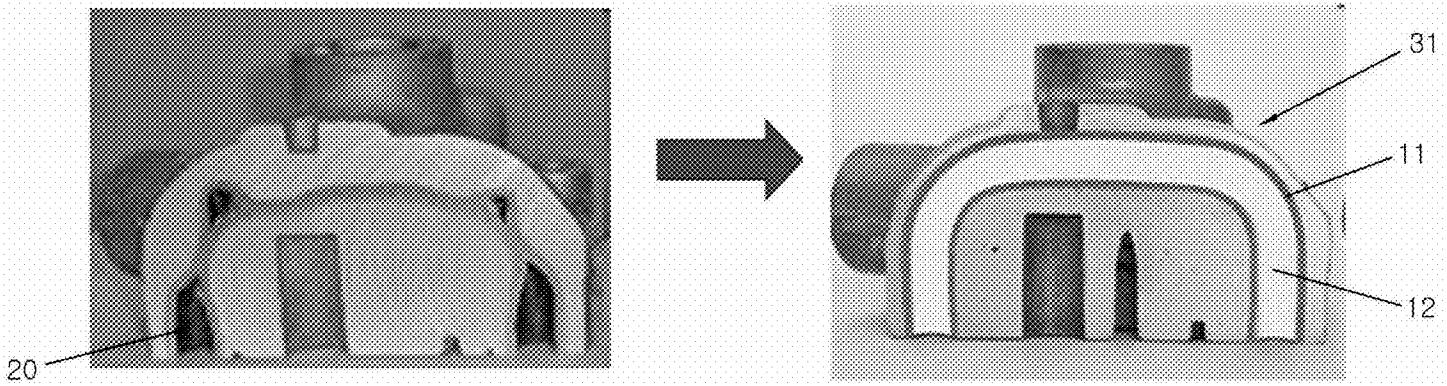
FIG. 3 illustrates a cross-sectional shape of a casting formed by the method according to the present disclosure and a cross-sectional shape of a casting according to a comparative example.

Furthermore, as shown in FIG. 3, in the case of a tubular pipe 20 formed of aluminum without a filler unlike the casting 31 formed by the method according to the present disclosure, the tubular pipe 20 is compressed during a high-pressure casting process, as illustrated in the drawing. Therefore, it is impossible to form a normal casting when the tubular pipe 20 is formed of aluminum without a filler.

If a casting is formed through a low-pressure casting process or a gravity casting process inserting an aluminum tubular pipe, the aluminum tubular pipe can be deformed by heat due to a relatively long casting process.

After the above-mentioned casting process has been completed, the filler is removed from the smart core by means of air or the like. As a result, the desired casting is completed. Here, a method of removing the filler may be changed depending on the materials of the filler to be used.

In other words, in the case where crystallized particles such as a salt is used as the filler, it is preferable that a physical removal scheme of applying a water jet of 200 bar or more to the tubular pipe is used.

In the case where uncrystallized particles such as a sand are used as the filler, the filler may be removed by injecting a water jet of 200 bar or more or air of 2 bar into the tubular pipe.

Furthermore, in the case where a mixture of a sand and a resin is entirely or partially used as the filler, the filler may be removed by burning resin included in the mixture through a heat treatment at 400° C. and then injecting a water jet of 200 bar or more or air of 2 bar or more.

However, since the purposes of the method of forming the casting according to the present disclosure are not only to prevent the smart core from being deformed during the high-pressure casting process, but also to fundamentally prevent a failure of the casting caused by remnants resulting from the filler in the flow passage, more detailed conditions for achieving the purposes may be applied to the tubular pipe and the filler.

Figure 4:
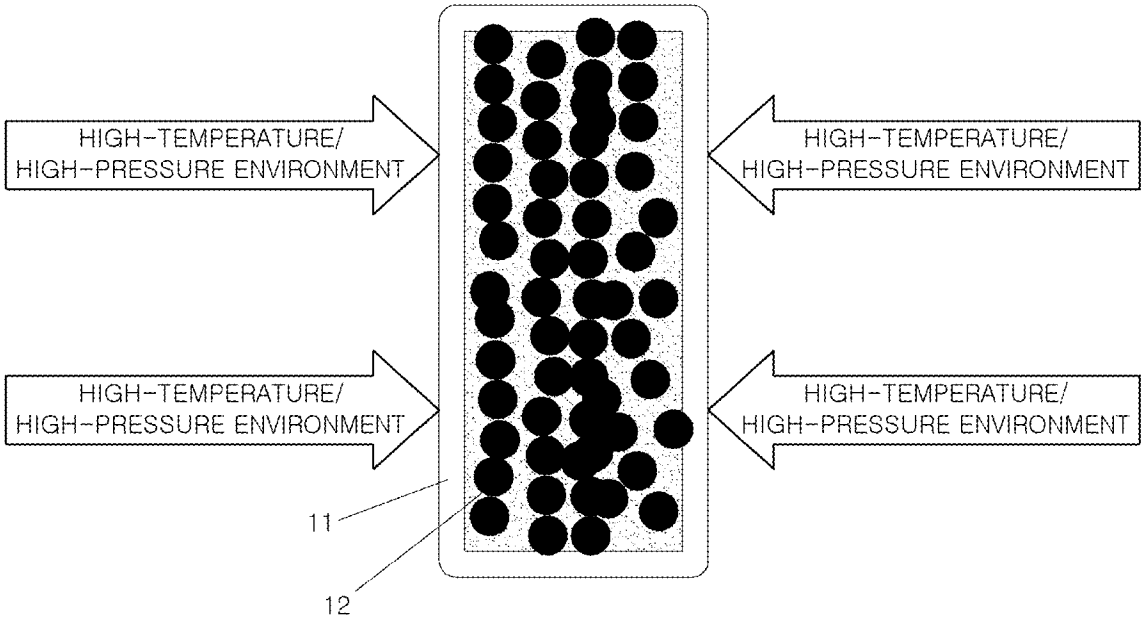
FIG. 4 illustrates a tubular pipe before a filler is removed in accordance with an embodiment.
Figure 5A:
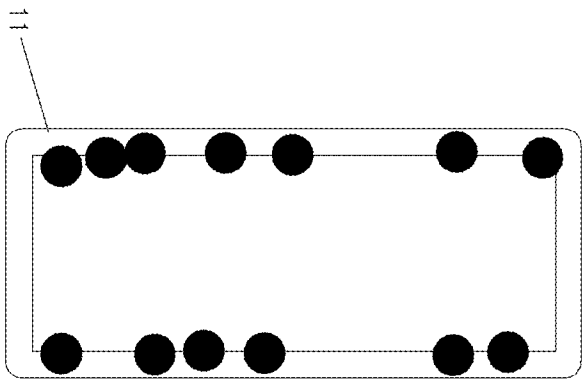
FIGS. 5A and 5B illustrate the probability of a problem occurring when the filler is removed from the tubular pipe of FIG. 4.
Figure 5B:
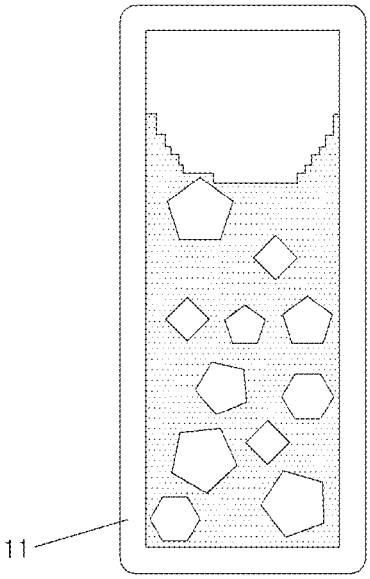

In other words, after the tubular pipe 11 and the filler 12 are subjected to the conditions under high-temperature and high-pressure environments as illustrated in FIG. 4, some of the filler 12 may remain in the tubular pipe 11 when the filler 12 is removed as illustrated in FIG. 5A, or the filler 12 may not be satisfactorily pulverized in the tubular pipe 11 as illustrated in FIG. 5B.

When some of the filler remains in the tubular pipe 11, the remaining filler is embedded in the tubular pipe 11 by the high-temperature and high-pressure casting environments. When the filler is not pulverized, the non-pulverized filler is crystallized and thus it becomes difficult to pulverize the filler.

Figure 6A:
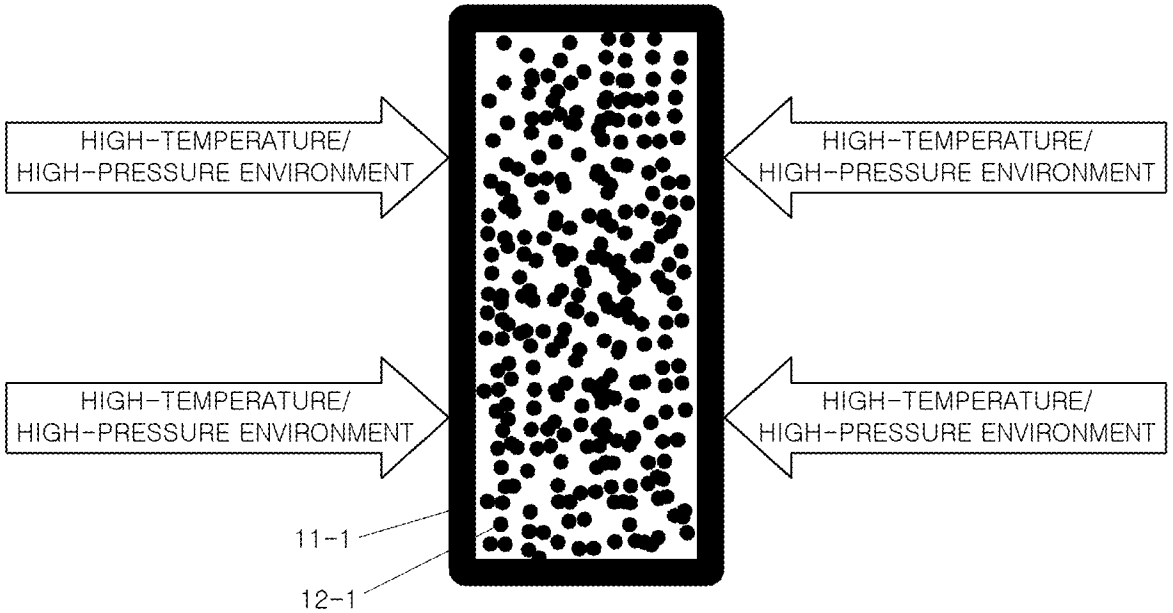
FIG. 6A illustrates a tubular pipe before a filler is removed in accordance with an embodiment different from that of FIG. 4.
Figure 6B:
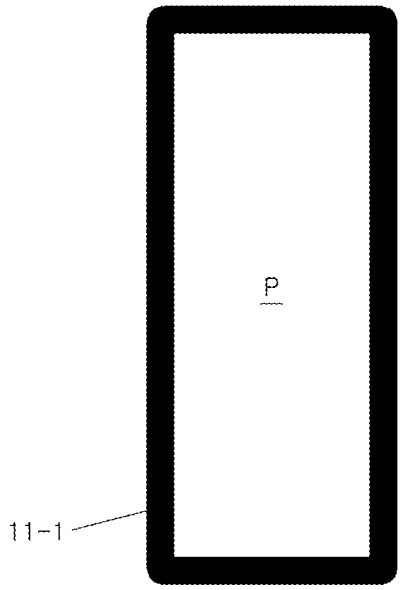
FIG. 6B illustrates a tubular pipe after the filler is removed from the tubular pipe of FIG. 6A.

To solve this, in another embodiment of the present disclosure, as illustrated in FIG. 6A, a tubular pipe 11-1 having an increased strength may be used, or a soft material that does not cohesively lump may be selected as the material of a filler 12-1. Thereby, as illustrated in FIG. 6B, after the filler has been removed, an undesirable filler compression or residual phenomenon is not caused in the flow passage P.

The present disclosure may be applied to a tubular pipe which may not endure high casting pressure during a high-pressure casting process. The present disclosure makes it possible the tubular pipe, which may not endure high casting pressure, to endure the high casting pressure during the high-pressure casting process, and thereby enabling to produce a casting with a flow passage having enhanced robustness.

Since the casting pressure of the high-pressure casting process is typically 60 Mpa or more, the present disclosure may be more preferably applied to a tubular pipe having appropriate specifications, e.g., using a material which may be deformed when it is processed through a casting process with casting pressure of 60 Mpa or more after being inserted into a mold.

A tubular pipe formed of aluminum may be an example of the tubular pipe which may be deformed when it is processed through a casting process with casting pressure of 60 Mpa or more. Table 1 shows the hardness of the aluminum tubular pipe which may endure the casting pressure of 60 MPa or more during an additional heat treatment process or the like, the elongation required for bending, and whether a filler remains.

Here, sand having a particle size of 100 μm is used as the filler.

TABLE 1

| Classification | | A6061-F | A6061-T4 | A6061-T6 | A6063-F | A6063-T4 | A6063-T6 |
|---|---|---|---|---|---|---|---|
| Hardness (Hv) | 1 | 64.9 | 79.4 | 88.3 | 57.4 | 79.5 | 90.2 |
| | 2 | 63.6 | 81.7 | 92.2 | 51.9 | 76.4 | 94.0 |
| | 3 | 66.6 | 78.5 | 90.7 | 62.7 | 78.6 | 91.8 |
| | 4 | 62.2 | 83.5 | 89.7 | 52.3 | 76.4 | 95.2 |
| | 5 | 66.6 | 79.9 | 91.7 | 58.0 | 78.3 | 89.6 |
| | AVE. | 64.8 | 80.6 | 91.7 | 56.5 | 78.3 | 92.2 |
| Elongation (%) | | 25 | 22 | 12 | 25 | 18 | 12 |
| Filler remnants | | ○ | X | X | ○ | X | X |
| Bendability | | ◎ | ○ | Δ | ◎ | ○ | Δ |

In Table 1, A6061 and A6063 indicate aluminum material, and T4 and T6 indicate the type of heat treatment.

In the case where filler remnants are present, it is expressed by "○". In the case where filler remnants are not present, it is expressed by "×".

Furthermore, depending on the degree of bending, "○" indicates good condition, "◎" indicates very good condition, and "Δ" indicates normal condition.

To prevent the filler remnants from being present after a filler removing operation has been performed, it is preferable that the hardness of the tubular pipe is relatively high.

Therefore, in the case of aluminum material, it should have hardness of 70 Hv or more, like A6061-T4 or A6063-T4, not only to ensure high-pressure casting pressure during the high-pressure casting process but also to prevent filler remnants from being present.

On the one hand, if the hardness is comparatively high, the bendability is reduced. Therefore, in the case where there is a need to bend a tubular pipe, not only the hardness but also the elongation should be taken into account.

It may be understood that, if the hardness is excessively high like A6061-T6 or A6063-T6, the bendability is reduced because the elongation is low.

Therefore, as needed, it is preferable that the elongation be 15% or more.

Therefore, it is preferable that the tubular pipe of the smart core according to this embodiment of the present disclosure has hardness of 70 Hv or more and elongation of 15%, and is made of A6061-T4 or A6063-T4, as referenced in Table 1.

Since the foregoing conditions may be satisfied depending on the material of the tubular pipe and conditions of the heat treatment, A2024-T3 or A7075-T4 may be used in lieu of A6061-T4 or A6063-T4.

Although, by adjusting the conditions of the tubular pipe, filler remnants may be prevented from being present after the process of removing the filler, the effect of preventing the filler remnants from being present may be maximized by taking into account the conditions of the filler.

In other words, to prevent the filler from being compressed onto the tubular pipe and remaining in the tubular pipe, it is preferable that the filler have a particle size of 100 μm or less.

Furthermore, it is more preferable that the filler have no reactivity with the tubular pipe made of an aluminum alloy or the like.

If the size of each particle of the filler is greater than the above-mentioned conditions or the filler has a reactivity with the tubular pipe, the particles of the filler may be undesirably compressed by pressure in the tubular pipe while forming a dimple shape, and remain in the tubular pipe.

Furthermore, in the case where the thermal conductivity of the filler is high, the temperature of the filler may be increased by the temperature of the molten metal and thus melted or deformed. It is preferable that the thermal conductivity of the filler is within a predetermined range to prevent from melting or deformation by the temperature of the molten metal.

In other words, the thermal conductivity preferably ranges from 0.1 W/m·° C. to 1 W/m·° C.

In the present disclosure, any material may be used as the filler, so long as it satisfies the above-mentioned conditions related to the particle size, the reactivity, and the thermal conductivity, and it can be removed after a filler charging operation.

Preferably, sand or silica-based material may be used as the filler. More preferably, silica-based material having relatively fine particles may be used.

Figure 7A:
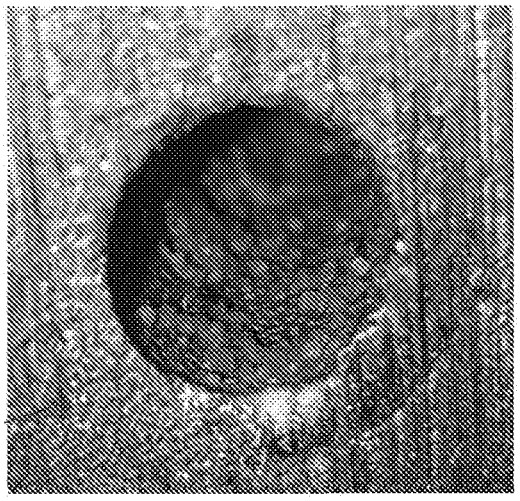
FIGS. 7A to 7*c* illustrate comparative examples of the tubular pipe after the filler is removed therefrom.
Figure 7B:
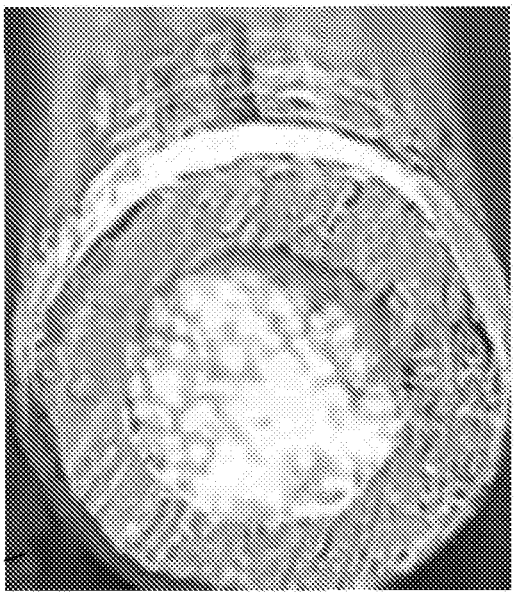
Figure 7C:
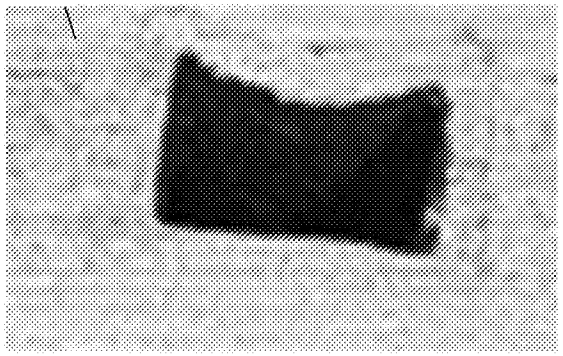

Table 2 shows comparatively examples of conditions different from the above-mentioned preferable conditions for the filler. A result of Case 1 is as shown in FIG. 7A, and a result of Case 2 is shown in FIG. 7B, and a result of Case 3 is shown in FIG. 7C. A pipe applied to the filler experiment of Table 2 refers to A6063-T4.

TABLE 2

| | Case 1 | Case 2 | Case 3 |
|---|---|---|---|
| Chemical Reactivity | None | Intermolecular bond | None |
| Thermal Conductivity | 0.35 | 0.2 | 1.2 |
| Powder Size(μm) | 500~1,000 | 10~40 | 50~100 |

In the case where the chemical reactivity and the thermal conductivity satisfy the corresponding conditions, but the powder size exceeds the conditions of 100 μm or less, as shown in FIG. 7A, the filler particles was undesirably compressed onto the inner surface of the tubular pipe.

In the case where the thermal conductivity and the powder size satisfy the corresponding conditions, but an intermolecular bond is caused due to the chemical reactivity, as shown in FIG. 7B, it was impossible to purge the filler from the tubular pipe.

In the case where the chemical reactivity and the powder size satisfy the corresponding conditions, but the thermal conductivity does not satisfy the conditions of a range from 0.1 W/m·° C. to 1 W/m·° C., the filler was melted and thus the tubular pipe was deformed.

Figure 8:
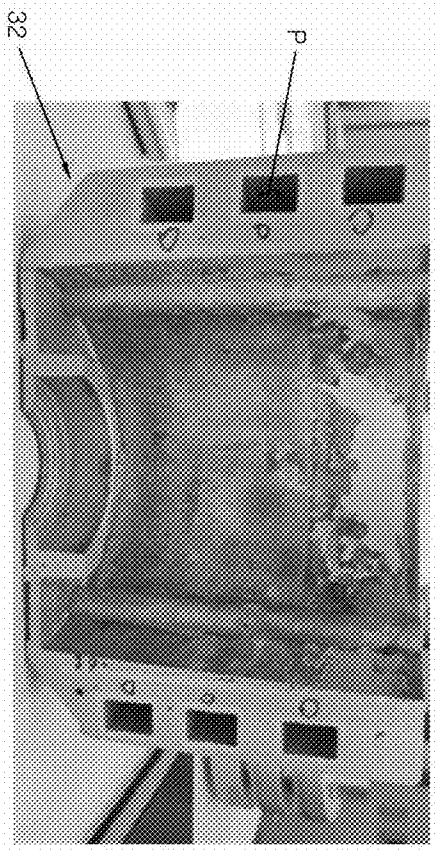
FIG. 8 illustrates a casting formed by a casting forming method in accordance with another embodiment of the present disclosure.
Figure 9:
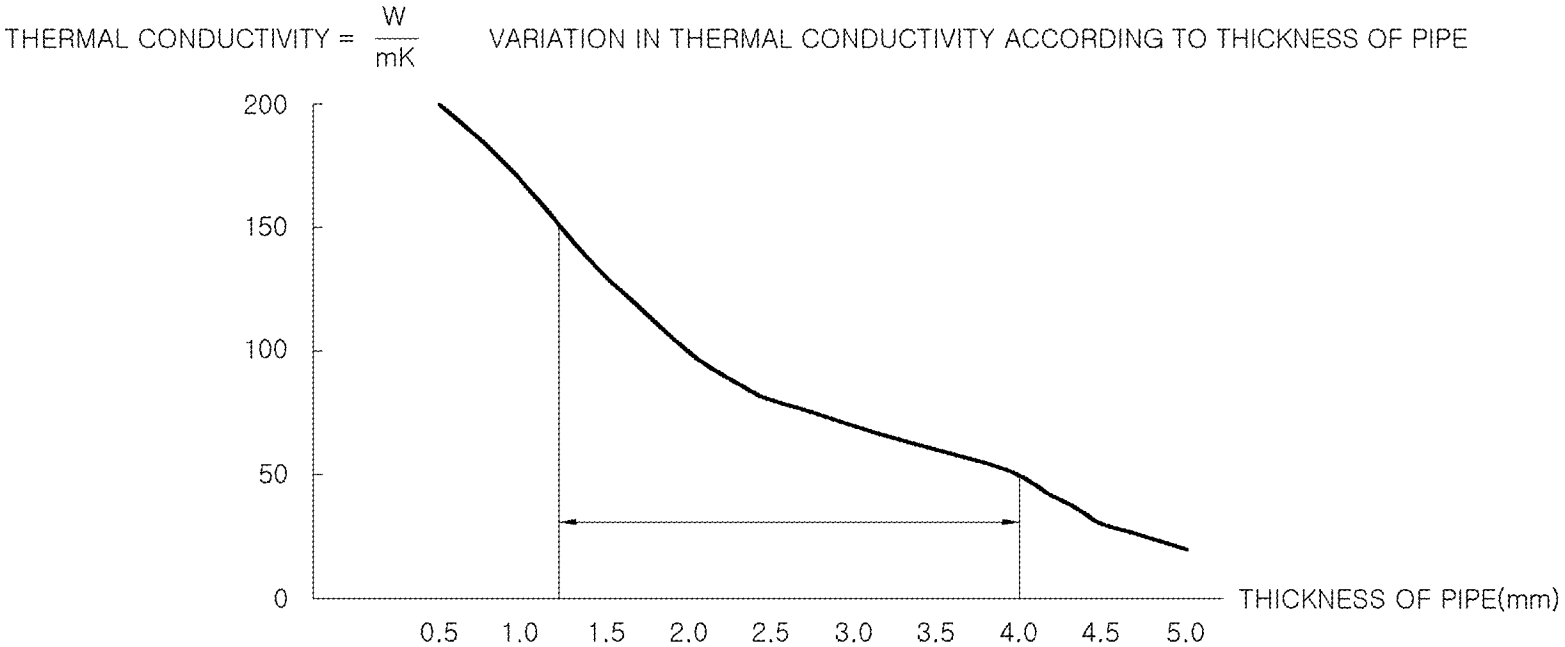
FIG. 9 illustrates a relationship between thermal conductivity and a thickness of a tubular pipe.

Unlike this, for example, in a casting 32 according to the present disclosure in which a tubular pipe made of A6063-T4 is filled with silica-based filler having no chemical reactivity, a thermal conductivity of 0.2 W/m·° C., and a powder size ranging from 10 μm to 40 μm as shown in FIG. 8, it may understood that remnants of the filler or a filler compression phenomenon did not occur in the flow passage P, and the flow passage P was not at all deformed.

As described above, according to the present disclosure, the flow passage is formed in the casting in a shape corresponding to the smart core. The casting may be formed into one piece through a single casting process.

Therefore, the robustness of the flow passage formed with the casting can be secured, and the production cost may be reduced.

Furthermore, in the case where the tubular pipe of the smart core of the present disclosure is made of aluminum, since the tubular pipe is inserted during a high-pressure casting process, the thickness (t) thereof is required to be limited to at least 1.25 mm.

In the case where the thickness of the tubular pipe is less than 1.25 mm, the tubular pipe may be melted in molten aluminum of 600° C. during a casting process.

In a typical die-casting process, an average time to produce a product ranges from 45 seconds to 100 seconds. 80% of this period is used for cooling the product.

In other words, the time it takes approximately about 35 seconds to about 80 seconds that a molten metal having a temperature from 660° C. to 680° C. is cooled to a temperature from 200° C. to 250° C. after the molten metal comes into contact with the tubular pipe. Here, the tubular pipe is required to stand high-temperature heat of the molten metal. If the thickness of the tubular pipe is less than 1.25 mm, the tubular pipe may be partially melted by the molten metal and thus lose its function.

Therefore, it is preferable that the thickness of the pipe of the smart core, which is used in the high-pressure casting process according to the present disclosure, is at least 1.25 mm.

In addition, referring to FIG. 4, if the thickness of the tubular pipe is 4 mm or more, it may be disadvantageous in terms of thermal conductivity of the tubular pipe because the thermal conductivity falls below 50 W/(m·K). Therefore, it is more preferable that the thickness of the tubular pipe is less than 4 mm.

In a method of forming a casting with a flow passage according to the present disclosure, a casting is integrally formed into one piece using a smart core, unlike the conventional art in which the casting is formed into two pieces. Therefore, there are economic advantages.

Furthermore, the method according to the present disclosure is not only directed to converting a component for a casting, but also directed to a component with a flow passage, which may be enhanced in robustness, compared to those of the conventional art. Therefore, a risk such as a vehicle fire may be prevented.

In addition, a failure of a casting due to remnants or the like in the flow passage may be minimized by taking into account the material of a tubular pipe and a filler.

Although the embodiments of the present disclosure have been disclosed with reference to the accompanying drawings, those skilled in the art will appreciate that various modifications, additions and substitutions are possible, without departing from the scope and spirit of the present disclosure. Therefore, these modifications, additions and substitutions may be regarded as falling within the claims of the present disclosure, and the bounds of the present disclosure should be defined based on the appended claims.

What is claimed is:

1. A method of forming a casting with a flow passage, comprising:

filling a tubular pipe with a filler to form a smart core;

filling both ends of the tubular pipe with resin;

inserting the smart core into a mold having a cavity corresponding to a shape of the casting to be formed;

injecting a molten metal into the cavity through a casting process;

cutting out portions of the tubular pipe that are filled with the resin; and removing the filler from the smart core, wherein a hardness of the tubular pipe is 70 Hv or more, the method further comprises after filling both ends of the tubular pipe with resin and before inserting the smart core into the mold:

drawing and extruding the tubular pipe filled with the filler such that the filler is compacted to at least 95%; and bending the tubular pipe filled with the filler in a shape corresponding to a shape of the flow passage to be formed in the casting, wherein the molten metal and the tubular pipe are formed of an identical material, and the tubular pipe is formed of aluminum.

2. The method of claim 1, wherein the casting process is performed through a high-pressure casting process.

3. The method of claim 1, wherein an elongation of the tubular pipe is 15% or more when tensing the tubular pipe which is not filled with the filler.

4. The method of claim 1, wherein a particle size of the filler is 100 μm or less.

5. The method of claim 4, wherein a thermal conductivity of the filler ranges from 0.1 W/m·° C. to 1 W/m·° C.

6. The method of claim 1, wherein a thickness of the tubular pipe is 1.25 mm or more and less than 4 mm.

7. A method of forming a casting with a flow passage, comprising:

filling a tubular pipe with a filler to form a smart core;

filling both ends of the tubular pipe with resin;

inserting the smart core into a mold having a cavity corresponding to a shape of the casting to be formed;

injecting a molten metal into the cavity through a casting process;

cutting out portions of the tubular pipe that are filled with the resin; and removing the filler from the smart core, wherein a particle size of the filler is 100 μm or less, the method further comprises after filling both ends of the tubular pipe with resin and before inserting the smart core into the mold:

drawing and extruding the tubular pipe filled with the filler such that the filler is compacted to at least 95%; and bending the tubular pipe filled with the filler in a shape corresponding to a shape of the flow passage to be formed in the casting, wherein the molten metal and the tubular pipe are formed of an identical material, and the tubular pipe is formed of aluminum.

8. The method of claim 7, wherein the filler is formed of silica-based material.

9. The method of claim 7, wherein a thermal conductivity of the filler ranges from 0.1 W/m·° C. to 1 W/m·° C.

* * * * *